US005730644A

United States Patent [19]

Pfanstiehl

[11] Patent Number: 5,730,644

[45] Date of Patent: Mar. 24, 1998

[54] PAINT BLEMISH REPAIR KIT

[76] Inventor: John Pfanstiehl, 22025 US 19N, Clearwater, Fla. 34625

[21] Appl. No.: 559,622

[22] Filed: Nov. 20, 1995

[51] Int. Cl.[6] ..... B24B 1/00

[52] U.S. Cl. ..... 451/28; 451/466; 15/169; 15/179; 15/358; 206/229; 401/126; 401/269

[58] Field of Search ..... 206/361, 582, 206/229; 132/313, 317, 319, 320, 218, 216; 15/105, 106, 168, 169, 184; 451/466; 427/368, 429

[56] References Cited

U.S. PATENT DOCUMENTS

| | | | |
|---|---|---|---|
| 1,577,400 | 3/1926 | Friedman | 206/229 |
| 2,945,252 | 7/1960 | Martineau | 401/269 |
| 3,193,863 | 7/1965 | Myers et al. | 15/169 |
| 3,577,839 | 5/1971 | Charvat | 15/179 |
| 3,638,785 | 2/1972 | Casteel et al. | 206/229 |
| 4,522,523 | 6/1985 | Vogelsang | 401/126 |
| 5,203,123 | 4/1993 | Travis | 15/358 |

FOREIGN PATENT DOCUMENTS

| | | | |
|---|---|---|---|
| 88340826 | 4/1987 | Japan | 451/287 |
| 1526716 | 7/1977 | United Kingdom | 401/126 |

*Primary Examiner*—Robert A. Rose
*Assistant Examiner*—George Nguyen

[57] ABSTRACT

A repair kit and method facilitate a quick and durable paint repair on any color vehicle or other painted item. The kit includes a fine abrasive surface preparation tool, an applicator, and a universal touch-up paint. A second embodiment adds a small flexible rubber sanding block, a plurality of pre-cut ultrafine sanding papers, and an ultrafine polish having an abrasive selected to remove sandpaper scratches and restore the gloss to sanded paint. These elements combine to produce a smooth unbroken surface finish in a repaired area when used for paint repairs with a matching color touch-up paint. One embodiment of the fine abrasive surface preparation tool is a reusable, retractable brush to hold fiberglass bristle cartridges and provides room for a warning label and storage for a spare cartridge. A second embodiment is a low cost fiberglass brush which is disposable and has a cap to cover the bristles when not in use and during shipping.

6 Claims, 8 Drawing Sheets

PAINT BLEMISH REPAIR KIT

BACKGROUND

1. Field of the Invention

This invention relates, generally, to touch up kits for the repair of damaged paint. More particularly, it relates to a kit that reduces the level of skill required to perform a professional quality repair.

2. Description of Prior Art

Although every vehicle driven on the road has or will have paint chips, a survey of available paint repair products at auto parts stores, department stores, new car dealerships and similar businesses indicates that such businesses carry only a small, inadequate rack of touch-up lacquer based paints. Although hundreds of millions of products have been purchased over the years to repair paint chips, major manufacturers in this field have never introduced an effective and inexpensive repair kit for the consumer.

The need for prompt repair of chips and scratches in automotive paint is even more urgent today than it was in the past, in view of the use of thinner metal for automotive outer body panels and the need to preserve today's factory paint and rust-through warranties.

An effective paint chip repair kit would provide means for effective surface preparation and paint application; it would also include a universal touch-up paint. An even better cosmetic repair would require still further elements, such as special sandpaper and polish, to restore a smooth, flat, unbroken surface to the finish.

Proper surface preparation is a critical first step in any paint repair job, large or small; it is also the most neglected aspect in consumer paint chip repair. If surface rust, road film, tar, wax, silicone, moisture, salt and the like are not removed, the touch-up paint will separate from the surface and create a pocket that wicks in moisture and accelerates destruction of the steel panel and blistering of surrounding paint. Moreover, if the surrounding paint is not sufficiently "scuffed," the touch-up paint will not adhere at the edges of the repair, again creating a separation that traps moisture and accelerates deterioration of the paint and substrate.

The most common means of surface preparation for paint chips and scratches are chemical rust-converters, scraping, sanding, and glass fiber bristle brushes.

Chemical rust-converters use phosphoric acid-based compounds to chemically change iron oxide to a nonoxidant. 3M Corporation's RUST AVENGER (trademark) is a pen-shaped device that enables a user to apply such a compound to paint chips and scratches. Chemical rust converters are unable to remove road film, tar, wax, moisture and salt, or abrade the paint that surrounds the chip.

The automotive industry is now employing plastic and aluminum for many body panels. Corvette, Avanti, and Fiero cars have long had outer body panels made of plastic materials. More recently the Saturn, GM mini vans, and new Camaro/Firebirds use plastic extensively for their outer body panels. Aluminum is employed in various Cadillac fenders and hoods and is increasingly used in Ford Motor Company's models. Chemical rust converters are inappropriate for all these applications. It should be noted that chemical rust converters are also inappropriate for steel panels where the chip or scratch does not extend to the bare steel through the primer, E-coat, and galvanized layers.

A paint touch-up kit having a bottle and cap that includes a blade-like tool for rust removal is described in U.S. Pat. No. 4,522,523. However, surface preparation that includes scraping with such a tool has serious drawbacks. The tool may not necessarily abrade the surrounding paint, but a slip can easily cause more damage than the original chip. Scraper tools are also inadequate to remove all the road film, tar, wax, silicone, moisture and salt from the surface undergoing preparation because the tips of such tools are wide relative to the small recesses, low spots, rust pits and the like that require cleaning. Thus, such scraping instruments hit only the high spots of the surface being prepared.

Sanding presents problems similar to those of scraping. The backing that forms a part of standard sandpaper does not flex sufficiently to get into small recesses or into the corners of chips and scratches. Moreover, sandpaper unnecessarily removes layers of paint contiguous to the chipped area. Feather edging, a phenomenon associated with sandpapering, is appropriate for blending the surfaces of large paint and body work repairs but it creates problems for chip and scratch repairs. If a smooth unbroken surface is to be restored to the paint finish, feather edging necessitates the filling of contiguous areas with touch-up paint in decreasing thickness as the touch-up paint approaches the edges of the sanded area. When the film thickness of the touch-up paint is reduced to 1 mil or less, cracking, separation and delamination become likely.

For most consumers, glass fiber bristle brushes provide the best surface preparation. Such brushes are so effective that they are also the tool of choice for many professionals. The diameter of each individual bristle is about two thousandths of an inch, enabling it to get into small recesses and rust pits. The fiberglass is sufficiently strong to brush away surface rust without abrading contiguous paint. Experiments have shown that with light pressure, the bristles are similar to 2000 grit sandpaper; with greater pressure, they sand like 400 grit paper. Such brushes also remove road film, tar, wax, silicone, moisture and salt from the surface while properly scuffing the edges of the chip or scratch as required to achieve long lasting adhesion by the touch-up paint. Such brushes work equally well with and without detrimental effect to aluminum and plastic substrates, primer, E-coat, or galvanized undercoats.

The glass fiber bristle brushes heretofore known, however, have certain shortcomings.

For example, Lowe, a German company, manufactures a brush having no moving parts. It includes a glass fiber cartridge that cannot be retracted or advanced without disassembling the holder; it also requires handling of the glass fiber cartridge. The design includes room in the body of the brush for the storage of extra cartridges, but some disassembly is required to gain access thereto. A user must grasp the fiberglass cartridge to advance the bristles as they wear. Perhaps more importantly, retraction of the bristles also requires handling of the cartridge. This is problematic because the fiberglass strands break off the sides or end of the cartridge and become temporarily embedded in the skin. Thus, the cartridge should be retracted when the tool is stored, but such retraction requires disassembly of the tool as aforesaid; accordingly, the average consumer leaves the bristles unretracted. Thus, when the brush is later retrieved from a drawer or other storage location, fiberglass bits get into the skin of the person retrieving the tool.

Another product in this field, manufactured for Northstar, is known as the RUST SURGEON (trademark). Advantageously, the cartridge can be extended or retracted by turning the cap, but the device includes no storage area for replacement cartridges. The cartridges are shipped loosely in the package, and loose fiberglass penetrates the skin of the person who opens the package; it also spreads all over the table or other work place.

The lack of any storage means for the cartridges within the tool also makes it easy for the cartridges to get lost or misplaced. Safety considerations are also a problem because typically the loose cartridges are placed in a desk, kitchen drawer, or tool box. Without proper storage, the fiberglass stands break off and pierce the hands or arms of people reaching into such drawers or tool boxes. Moreover, the design greatly increases the risk that the cartridges might be handled by children.

Although fiberglass has been used in homes and industry for decades, ranging from structural materials and tools to insulation, and although common sense should tell people to keep tools containing fiberglass out of the reach of children, the increasing litigious nature of society makes reduction of product liability exposure of paramount importance to manufacturers and distributors. It is not sufficient to have warnings on packaging alone because the original packaging may not be seen by secondary users. It would therefore be advantageous to have adequate space on the tool itself for a permanently attached, sufficiently large warning label, but earlier tools in this field lack said sufficient space or are otherwise not amenable to the placing of warning signs thereon. For example, the Lowe device has a grooved outer surface that is unsuitable as a mounting location for a warning label, and the Northstar device has a label-defeating narrow, multifaceted outer surface. Moreover, the Lowe device requires frequent disassembly, thereby rendering impractical the placing of a permanent warning label thereon.

The earlier devices also have several structural disadvantages. For example, the Northstar design uses a coiled wire as a spiral thread so that rotation of the cap forces a pawl down the wire. The wire is therefore the only axial support for the cartridge; it can be pushed back into the tool during use.

The Northstar design also includes separate metal components; accordingly, a single mold cannot be used to make all of said components. The design also employs internal threads the fabrication of which requires very expensive and sophisticated molds. Moreover, to produce an aesthetically pleasing multicolor tool, the parts must be made with different colors of plastic; this requires a split mold or two separate runs using an unsplit mold.

Conventional paint application tools include touch-up paint bottles that include built-in brushes, specially designed pin stripe style brushes, and small spray equipment; each of these has significant drawbacks.

Some touch-up paint bottles have a brush attached to the bottle cap, but the brushes are far too large for the repair of most paint chips, i.e., they are too wide and they deliver too much paint. When wetted they are typically 0.140 inch in width at the bristle end, whereas a typical paint chip is only about 0.090 inch in diameter and 4 mils in depth, thus requiring only about 0.1 grams of paint. A typical touch-up paint bottle brush delivers as much as 0.5 grams in the first drop transferred. For this reason, professional automotive paint refinishers generally prefer to use paper matches to apply touch-up paint.

Specially designed brushes are not usually sold in most auto parts stores, department stores or car dealerships. In addition, they are more expensive (generally $15 and up) than most consumers would want to pay for a one-time use. Their effective use also generally requires experimentation and practice. Moreover, they have to be cleaned after each use.

Spray equipment has the multiple drawbacks of initial cost, difficulty of use, the need for paint mixing, the requirement of masking surrounding areas, and the application of paint where it is neither wanted nor required. A paint repair kit sold by B&M Automotive costs $40 to $50 and uses a small sprayer connected by a long hose to a vehicle's tire valve.

After surface preparation and application of touch-up paint to a paint chip, the finish is still not cosmetically restored because the touch-up paint forms a raised surface that must be brought down to a level flush with the original paint.

U.S. Pat. Nos. 5,082,692 and 5,077,086 disclose methods wherein a soft, flexible sheet material applies specially blended solvents to dissolve and wipe off excess touch up paint while the paint is partially set. Several significant problems are associated with such process. As the repaired painted surface is wiped with solvent, paint must not be removed from the chip or scratch but excess touch-up paint must be completely removed. Flexible material naturally pushes down into repaired chips or scratches which are filled with partially set touch-up paint. Furthermore, solvent naturally flows into such low lying areas. Solvent is not an exact or efficient means of creating a smooth and flat surface to a partially set painted area, particularly when the solvent is applied by wiping the surface with a flexible material. Resulting edges, waviness and wipe marks are clearly visible to the naked eye. Moreover, partially set touch-up paint shrinks as solvents therein evaporate. As a result, a recess or depression develops in the touch-up area after a few days. Such depressions or other surface imperfections as small as a few ten thousandths of an inch are visually discernible on a good automotive finish.

The Final Finish System (trademark) marketed by Eastwood uses small circular pieces of sand paper which have scalloped edges. Because they are so small, the paper requires an adhesive system for mounting to a custom sanding spool which further increases cost.

Additionally, the circular design, along with the scalloped edges, creates a considerable amount of waste because these pieces are die cut from standard sheets of sand paper.

Additionally, the circular design of the pre-cut sandpaper is not well suited to paint chip repairs. As the pieces are rotated, very little sanding occurs at the center of the disc where the paint chip is located and therefore where the most paint needs to be removed. During each revolution, the largest relative surface motion is at the edges because of their distance from the axis of rotation. The result is that the most sanding occurs where it is least wanted, and the least sanding occurs at the one place where it is most needed.

The Final Finish System has no means to prepare the surface, and it lacks paint applicators and a universal touch up paint.

A good paint blemish repair job must end with application of a suitable polish. However, finding a polish that can be applied by hand and that includes a proper abrasive is not an easy task for professional or consumer. There is no rating system on polishes, compounds and paint "cleaners" to grade their abrasive level, and the product description on the labels is generally not helpful in making this type of comparison. A consumer could spend hundreds of dollars on retail or trade polishes before finding one satisfactory for a particular grade of ultrafine paper.

SUMMARY OF THE INVENTION

The present invention overcomes all of the primary disadvantages of the prior art devices and methods. The novel system of this invention includes a fiberglass brush having a cartridge which is retractable and extendible without handling its fibers, has storage space for a replacement cartridge, and has ample room for a permanent, large and easy-to-read warning label. As an added advantage, the novel tool allows the consumer to immediately judge how much of the fiber brush has been used.

These improvements would not have been obvious in view of the pertinent prior art taken as a whole to one of ordinary skill in this art at the time the present invention was made as indicated by recently introduced products, such as RUST ERASER (trademark), which have solved none of the three primary problems.

The novel brush has further important functional and manufacturing advantages as well. For example, an earlier model of the brush is made with an inexpensive mold having no slides, and all pieces are made in a single shot. Color is added by an inexpensive label which is rapidly applied by semiautomatic or automatic labeling machinery.

A recently developed model is manufactured by employing slides in the mold to enable production of a one piece outer housing and a one piece inner screw which permits faster assembly than possible with the older design.

The applicators in the present invention are similar to paper matches but include two significant improvements. First, they have no flammable chemicals on their end. Secondly, printing on the cover of the novel applicator box shows users how to cut and use the applicators which can be easily cut to a point as small as 0.020 inch or less and which can be used to apply very small quantities of paint. Additionally, by applying very small quantities of paint and by wiping it onto an area to be repaired, the paint film can get into recesses without trapping air bubbles.

The applicators of the present invention are also inexpensive and disposable.

A universal touch-up paint is an important part of the invention because of the difficulty of obtaining a proper color match in most cases. According to DuPont and other major automotive paint manufacturers, there are over 50,000 colors of paint used on automobiles today. Well-stocked paint stores seldom have more than a hundred colors available on the shelf. New car dealerships have the same problem; customers frequently leave the parts counter without having been able to purchase the proper color. The large number of colors needed for today's market make it cost prohibitive for distributors to stock all colors of touch-up paint. Stocking of paint repair kits which have various colors would be even more costly and substantially less practical. A clear touch-up paint is included in the novel kit because an owner should seal off a break in the paint as quickly as possible. The clear touch-up paint provides a satisfying solution for any immediate touch-up regardless of the color of the vehicle. Clear touch up paint does not make the chip look any more obvious, nor does it have any pigments to stain or bleed into the surrounding paint. Furthermore, clear paint is an advantage even for consumers who have the proper color touch-up paint. Most cars manufactured today have a clearcoat of paint over their color coat. The clearcoat adds further gloss, and further protection from color fading. The clear paint in the novel kit enables consumers to more closely duplicate the original finish of the surrounding paint when applied over the colored touch-up paint. Corrosion inhibitors in the clear paint provide a benefit not found in the touch-up paints heretofore known.

The present invention uses the following three components to produce a smooth unbroken surface over the repaired area: a small pliable sanding block, precut strips of micro fine polishing sand papers, and a micro fine polish.

The flexible sanding block is made of NEOPRENE (trademark) synthetic rubber or similar flexible materials and is small, 1 to 2 inches, to best suit spot sanding of small areas. The flexibility of the sanding block permits its use on the highly curved surfaces found on many cars today. Advantageously, it can be bowed by squeezing the sides to allow a very small contact area when sanding. It is highly desirable to concentrate the sanding on the high areas of touch-up paint and minimize the sanding of surrounding paint. A thin rectangular shape allows edge sanding and sanding in hard to get at areas. Cutting the present invention's rectangular precut strips of sandpaper from larger sheets produces no wasted material.

The sandpaper of the present invention is of a very fine grit, typically from 1500 to 3000 grit. The fine grit provides two advantages. First, it minimizes the chance that an overzealous consumer will sand through the surrounding paint. Secondly, the finer grit enables the gloss to be returned to the finish with use of only one polish.

Experiments have shown that a used piece of 2000 grit sandpaper used with a gentle flow of rinsing water will sand down the excess build up of touch-up paint in as few as 10 to 20 strokes and therefore is sufficiently aggressive to sand the repair flush with the surrounding paint in a short period of time. However, with normal pressure the same sandpaper will only remove one ten thousandth of an inch of factory paint with 100 strokes and therefore is safe for use by any consumer who heeds the directions.

This is also important today because current specifications of major car manufacturers state that if 0.3 to 0.5 mils (three to five ten-thousandths of an inch) of paint are removed from horizontal (top) panels, they may have to be repainted.

The present invention reduces waste materials and time by precutting the paper into strips to match the dimensions of the sanding block. It saves the consumer from having to gather tools for measuring and cutting the paper. It also saves material because most people will not do the latter but will instead tear the paper and thereby waste a lot of usable area. The microfine papers are not commonly found in department or auto parts stores. Although carried by some auto refinish supply stores, they are neither known nor easily accessible to most consumers, they are relatively expensive, they are not cut into strips to match the size of a sanding block, nor are they provided as a part of a repair kit.

The third component of the novel kit, the polish, is chosen with an abrasive level sufficient to remove microfine sandpaper scratches and restore the gloss to surrounding areas. Advantageously, the polish may be applied by hand. More importantly, it is the ideal polish to use in conjunction with the ultrafine paper provided with the novel kit.

It is therefore understood that the primary object of this invention is to provide a low cost paint blemish repair kit and method of use that is easy yet effective to use.

A more specific object includes the provision of an improved fiberglass brush having easily extendable and retractable bristles, space for a label, and a storage compartment.

Another important object is to provide a kit having components that work complementarily with one another and which would be difficult for an average consumer to assemble.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
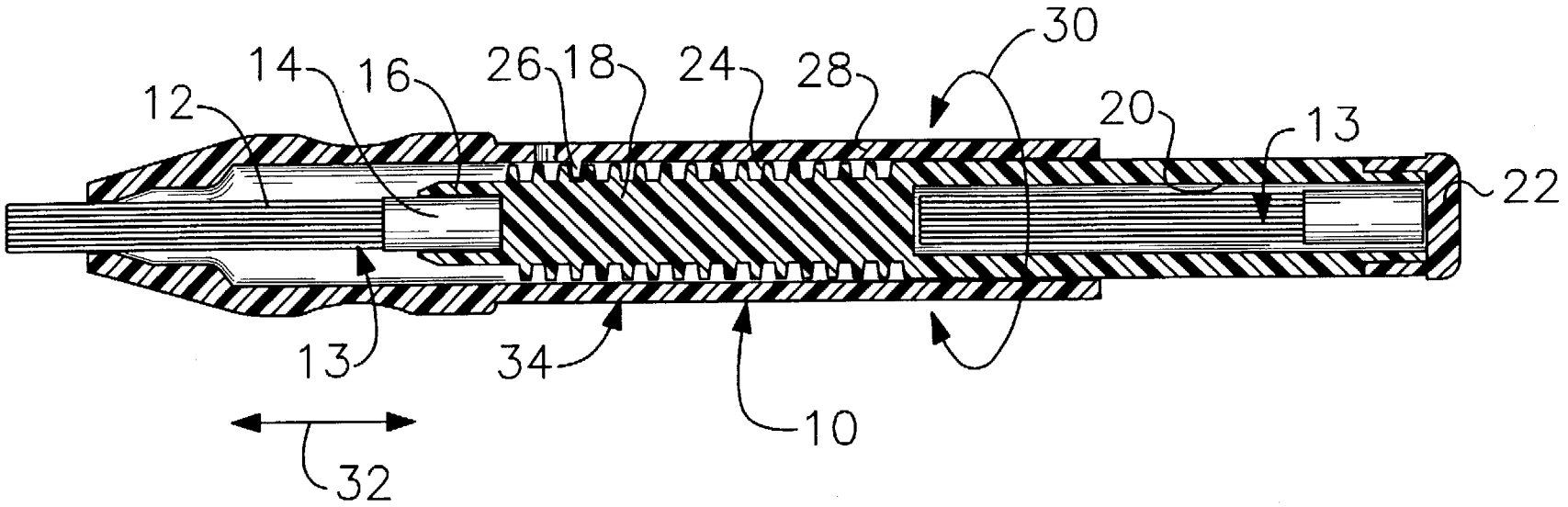
FIG. 1 is a longitudinal sectional view of an illustrative embodiment of the novel brush.

Referring now to FIG. 1, it will there be seen that a first embodiment of the novel fiberglass bristle brush is denoted as a whole by the reference numeral 10.

Brush 10 includes a bundle of fiberglass bristles 12 that are captured at their respective proximal ends by a bristle holder 14. Collectively, bristles 12 and bristle holder 14 form a cartridge 13. Holder 14 is in turn engaged by the distal end 16 of an inner barrel 18.

A cartridge-receiving cavity 20 is formed in the distal (trailing) end of inner barrel 18 for storage of a spare cartridge 13 as depicted. Cap 22 is press fit or otherwise releasably secured to the trailing end of inner barrel 18 and provides a closure means for cavity 20. In this way, a consumer gains access into storage cavity 20 without disassembling tool 10.

External threads 24 are formed in inner barrel 18 about mid-length thereof, and said threads are in screw threaded engagement with a radially inwardly extending pawl 26 formed on an internal surface of outer barrel 28. In this way, rotation of outer barrel 28 in a first direction relative to inner barrel 18 extends bristles 12 and rotation of said outer barrel in a second direction opposite to the first direction retracts said bristles. Such rotational movement is denoted by arcuate double-headed directional arrow 30, and the linear movement of the bristles is indicated by straight double-headed directional arrow 32.

Cylindrical outer surface 34 of outer barrel 28 provides ample space for a label containing product information and suitable warnings about fiberglass bristles.

Note that a lengthy extent of the trailing end of inner barrel 18 is exposed to view when bristles 12 are new, i.e., substantially unworn as depicted. As the bristles become worn with repeated use, inner barrel 18 is advanced to expose more bristles and less and less of the trailing end of said inner barrel remains visible to the user. Thus, the amount of inner barrel 18 that is visible to the user provides a rough gauge as to what extent of the bristles are available for use.

Note further that full retraction of the bristles into outer barrel 28 is accomplished with a simple relative rotation between the inner and outer barrels. This ease of retraction encourages consumers to store the tool properly and prevents needless fiberglass injuries arising from improper storage.

Tool 10 may be made with slides in a mold to enable production of a one piece outer barrel 28 and a one piece inner barrel 18; such one piece design enables faster assembly of the tool.

Figure 2:
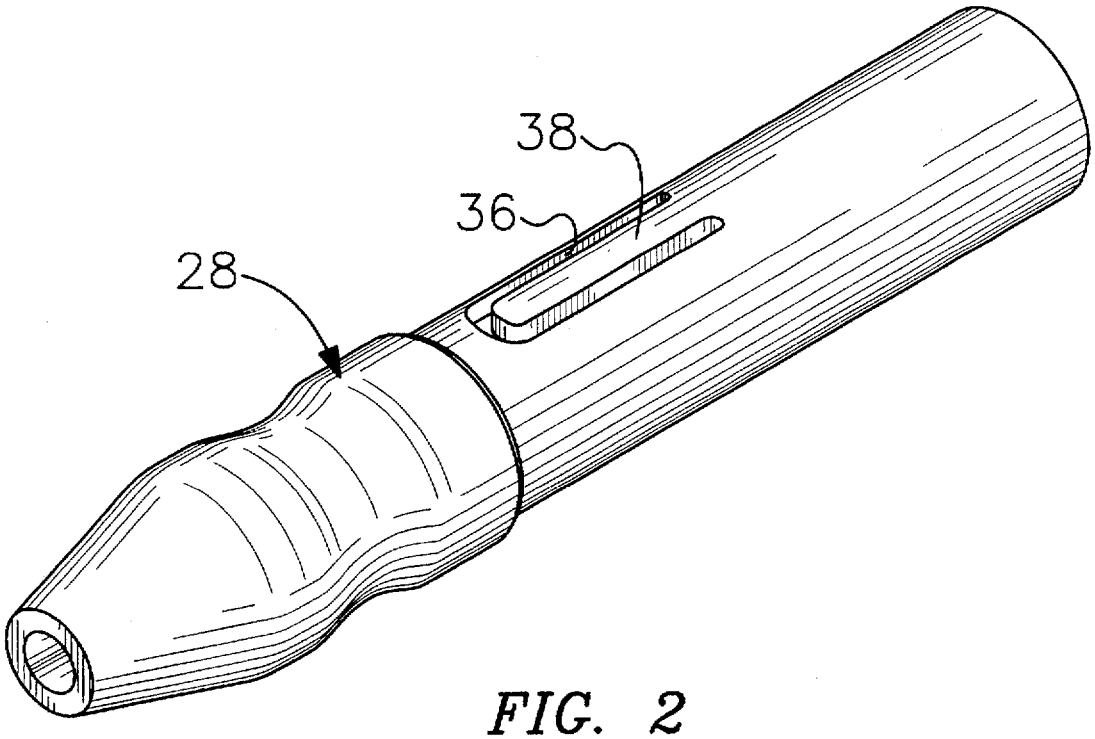
FIG. 2 is a perspective view thereof.
Figure 3:
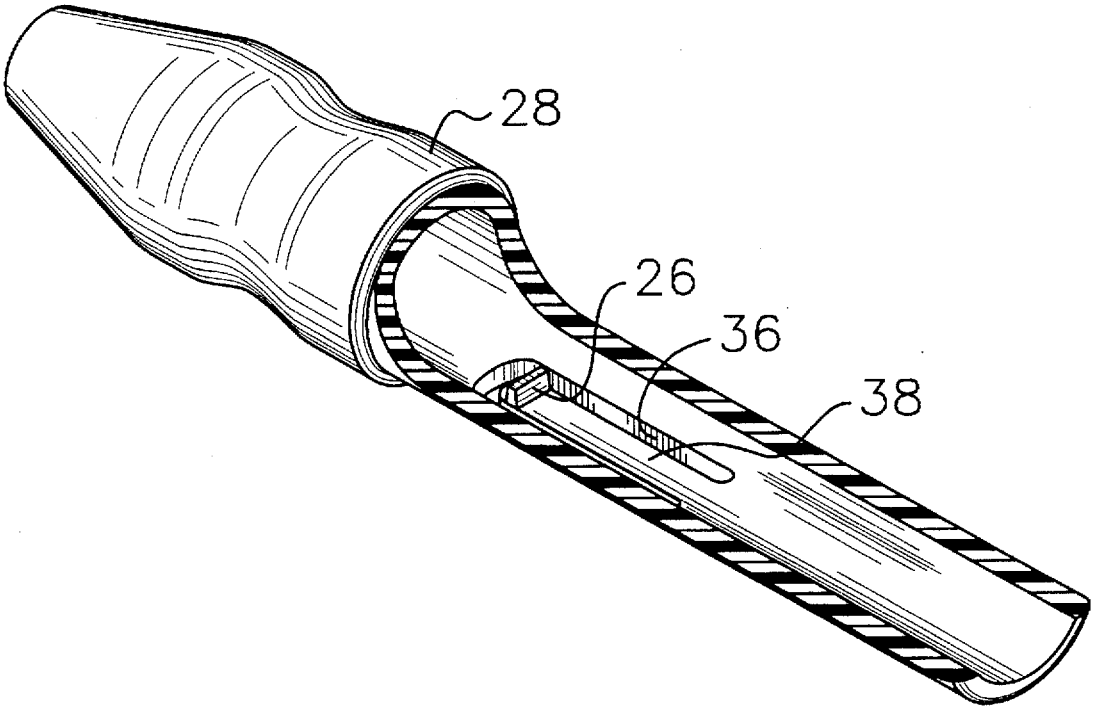
FIG. 3 is a cut away perspective view.

FIG. 2 provides a perspective view of the assembly of FIG. 1 with inner barrel 18 removed therefrom. A "U"-shaped slot 36 formed in outer barrel 28 enables momentary flexing of section 38 of said outer barrel when it is ejected from the tooling at the conclusion of the molding process where the inner and outer barrels are formed. Pawl 26 is formed on an inner surface of said section 38, as indicated in FIG. 3. Accordingly, section 38 and pawl 26 are momentarily displaced radially outwardly when the outer barrel is ejected by being pushed off the mold pin. This enables a relatively low cost mold which has no need for rotating elements to eject a part which has interior threads. After the outer barrel is ejected from the mold, the resilience of section 38 restores it to its position of repose, i.e., it returns to its FIG. 2 position where it is flush with the outer surface of outer barrel 28. Slot 36 is hidden from consumer's view a by label containing printed matter which is placed thereover during final assembly of the unit, there being no further need for flexing of section 38 at that time.

Figure 4:
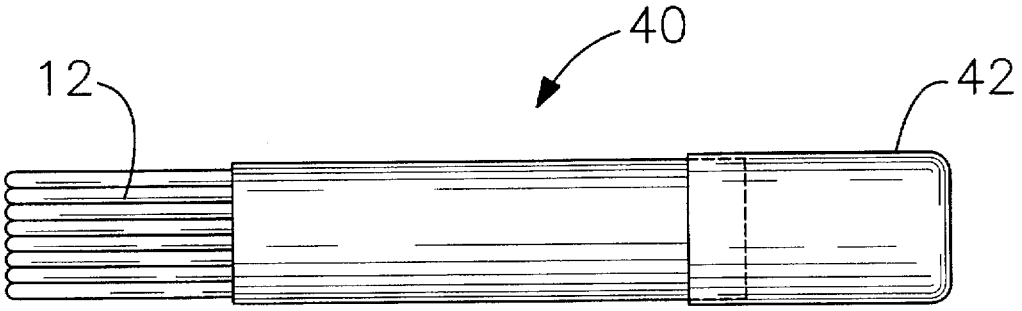
FIG. 4 is a side elevational view of a second embodiment of the fine abrasive surface preparation tool.

FIG. 4 depicts a simpler disposable brush 40; note that it includes an elongate base but lacks an outer barrel. Accordingly, bristles 12 are not retractable, but they are covered by a closure means 42 which is press fit onto the trailing end of the brush as depicted when the bristles are exposed. The bristles are much shorter than in the first-mentioned embodiment since brush 40 is used only once or twice before being discarded.

Figure 5:
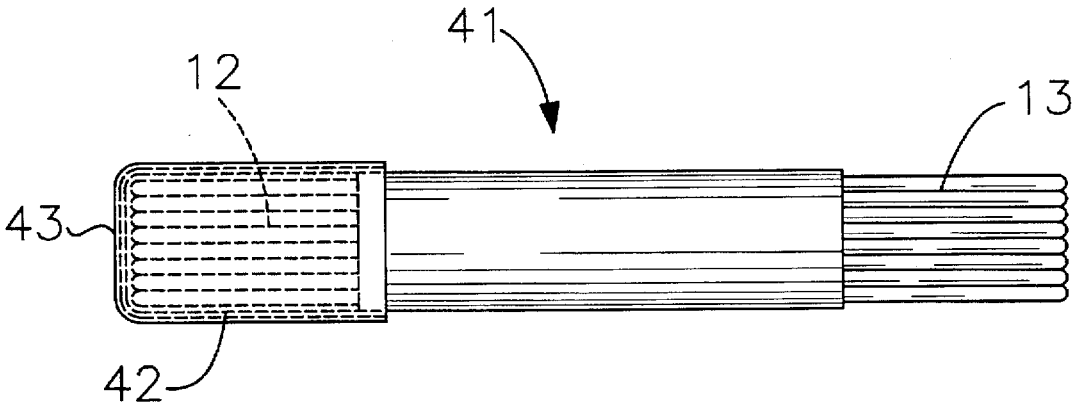
FIG. 5 is a side elevational view of a third embodiment of the fine abrasive surface preparation tool.

A variation of brush 40 is depicted in FIG. 5 and is denoted 41. Bristles 12 and 13 are provided at the opposite ends of the elongate base of this embodiment to extend its useful lifetime, and a pair of closure means 42 and 43 are provided as well; note in FIG. 5 that flexible, resilient closure means 43 overlies flexible, resilient closure means 42 when bristles 13 are exposed, and that both caps 42 and 43 are placed over bristles 13 when bristles 12 are exposed.

Figure 6:
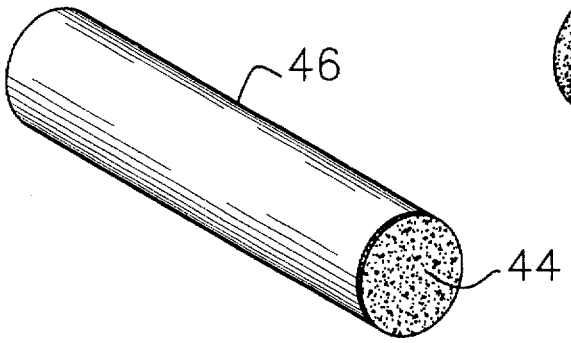
FIG. 6 is a perspective view of a fourth embodiment of the fine abrasive surface preparation tool.
Figure 6A:
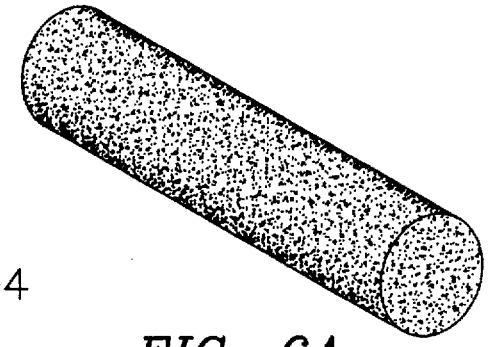
FIG. 6A is a perspective view of a variation of the fourth embodiment.

FIG. 6 depicts an even simpler version of the novel brush. In this embodiment, a thin piece of material 44 having an abrasive quality similar to that of bristles 12 is adhered to the leading end of a cylindrical holder or base 46. Base 46 of the device depicted in FIG. 6A to is made of abrasive material, thereby elminating the need for piece 44, i.e., new layers of abrasive are continually exposed as the device is used. Since the devices of FIG. 6 and 6A lack fiberglass bristles, they require no closure means.

Figure 7:
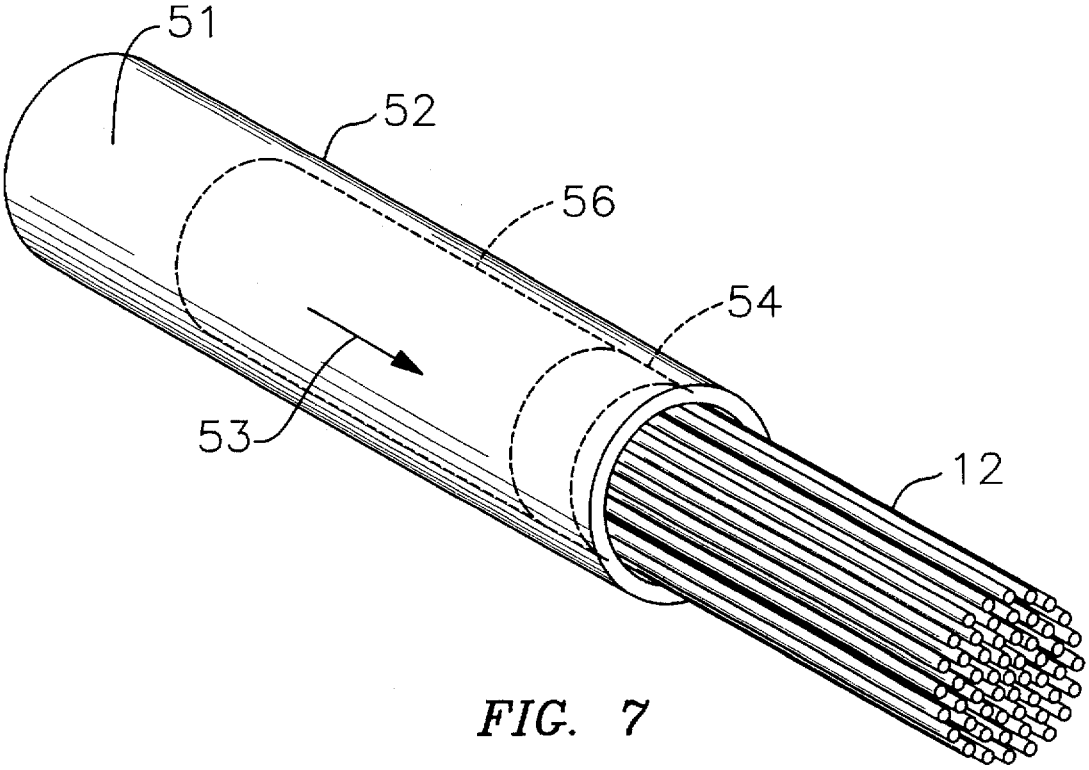
FIG. 7 is a perspective view of a fifth embodiment of the fine abrasive surface preparation tool.

Device 50 of FIG. 7 includes a flexible and resilient outer tube 52 that sliding receives a truncate rigid inner base 54 having elongate bristles 12 extending from its leading end.

A pusher device 56, also slideably received within outer tube 52, has a convex trailing end that abuts a trailing end 51 of outer tube 52. Accordingly, bristles 12 are advanced when worn by squeezing the trailing end 51 of outer tube 52; such squeezing advances pusher device 56 in the direction indicated by directional arrow 53, thereby exposing more bristles as desired. When the bristles are not in use, their collective leading end is pressed against a suitable support surface and pusher device 56 retreats into outer tube 52.

Figure 8:
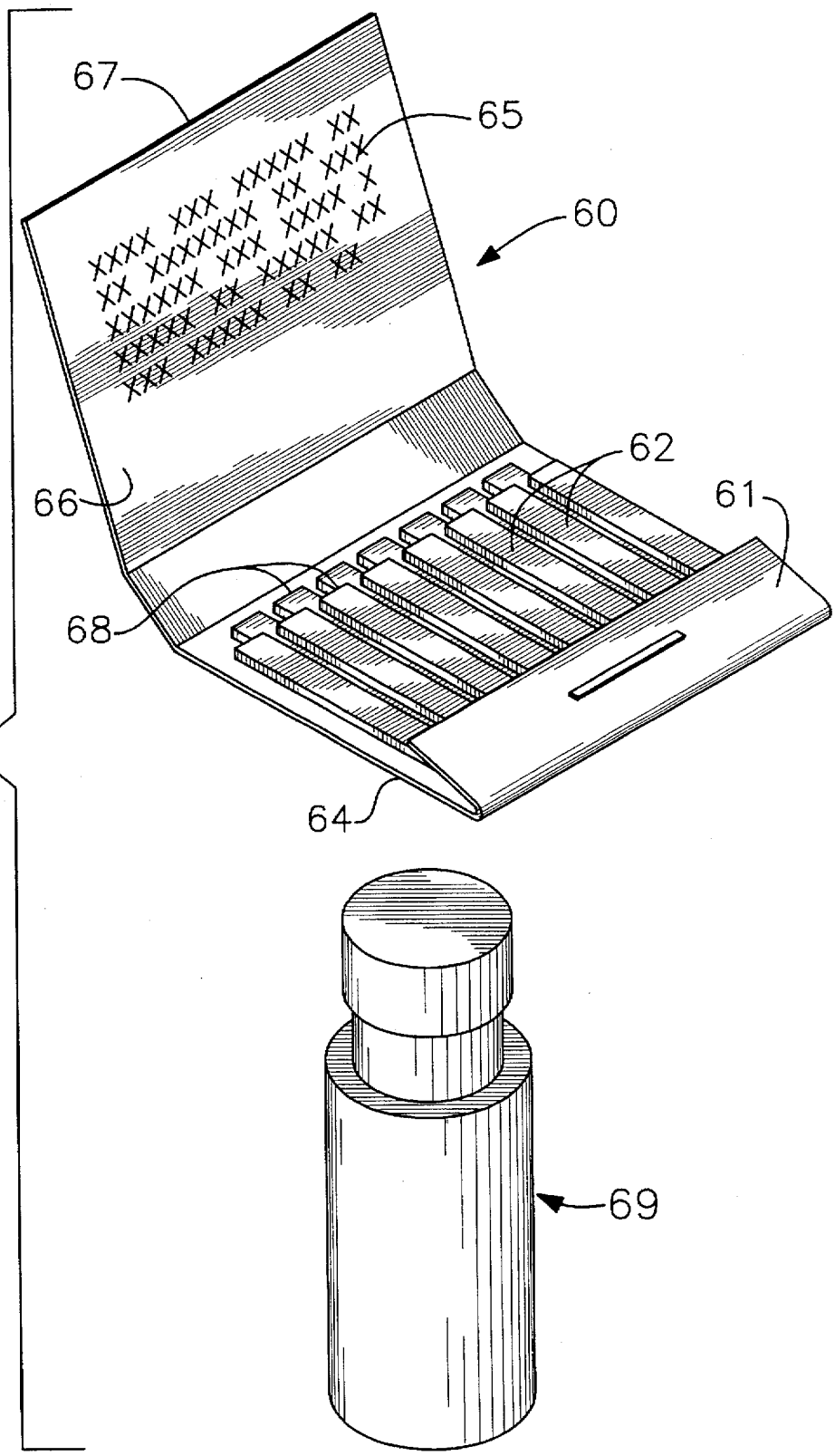
FIG. 8 is a perspective view of the novel applicators, together with a perspective view of a bottle of touch-up paint.

FIG. 8 depicts a storage container 60 for a plurality of paper match-like paint applicators, collectively denoted 62, that are detachably mounted to a base 64 and are torn therefrom in the same manner that paper matches are torn from a matchbook. Cover 66 contains instructional text 65 as to how applicators 62 are used, i.e., the user is told to cut the tips 68 thereof into points. The applicators are covered when in storage by cover 66, said cover having a free end 67 that is tucked under retention flap 61 in the well known way associated with paper match boxes. Applicators 62 differ from ordinary matches primarily in that no flammable substance is adhered to tips 68 thereof.

Applicators 62 are first used to apply a clear paint as set forth hereinafter; said clear paint is depicted in bottle 69 in FIG. 8. The clear paint of this invention is an anticorrosive solvent-based paints containing anti corrosion additives and conventional liquid solvent-based paints. Clear paint, or clear coat paint is transparent. Like primer, clear paint is universal in that it is compatible with all colors. Therefore a paint blemish repair kit containing clear paint or primer paint can be used with all vehicles and only one type of kit needs to be stocked by distributors and retailers. FIG. 8 should also be construed as depicting a bottle of primer and a bottle of colored paint as well; the use of primer, clear paint, colored paint, or combinations thereof are at the discretion of the consumer.

Figure 9:
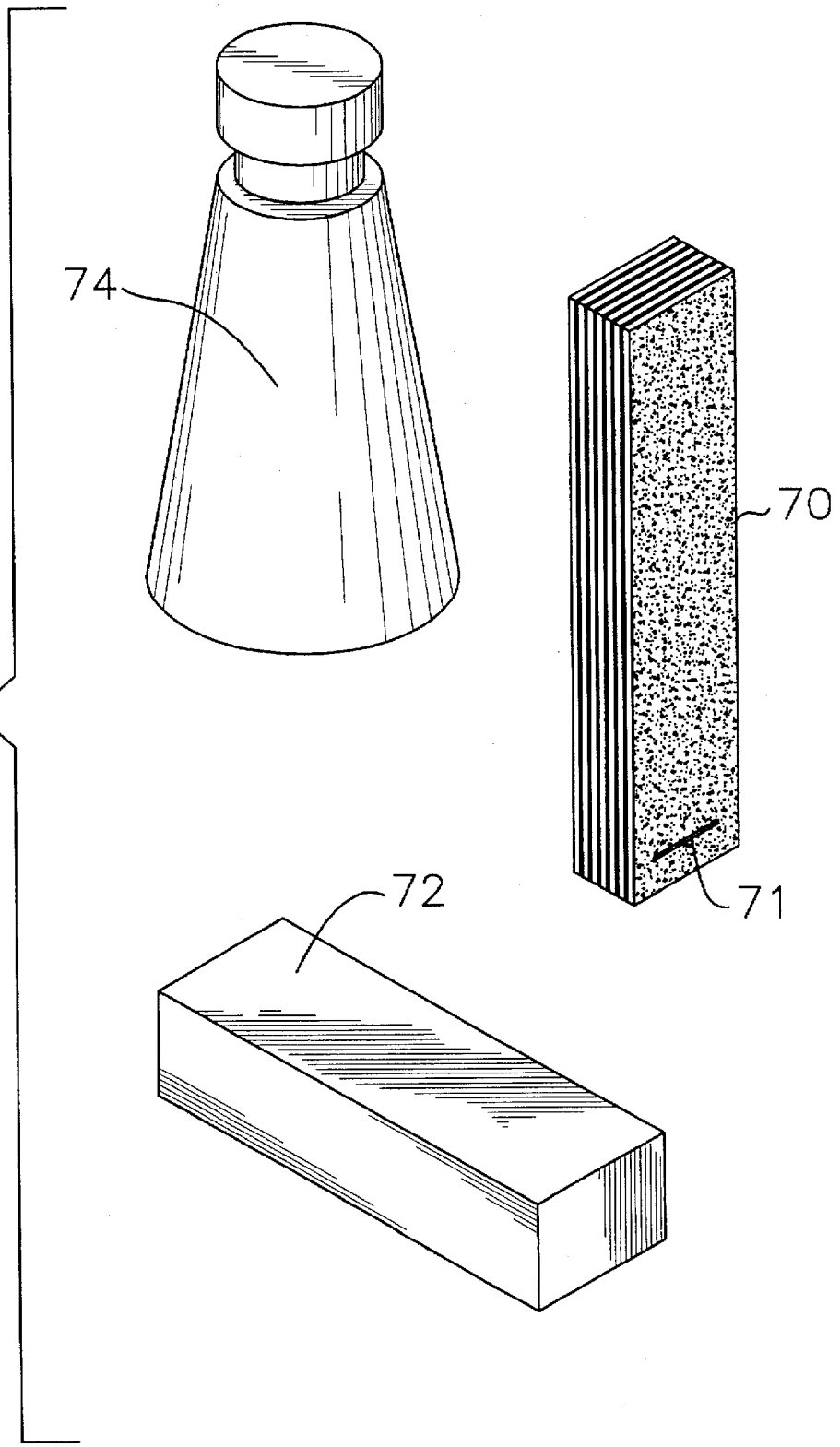
FIG. 9 is a perspective view depicting the novel pre-cut sandpaper strips, the novel flexible sanding block, and a bottle of polishing compound.

FIG. 9 depicts the sandpaper 70, flexible sanding block 72, and polish 74 used in the final steps of the novel repair method. Sandpaper 70 is pre-cut into strips, preferably 1.80 inches in width and either 3.66 or 5.50 inches in length, or to otherwise match the dimension of sanding block 72, and said strips are stapled together as at 71 to facilitate their storage and use. Sandpaper 70 may be dry or wet sandpaper and have a grit ranging from 1500 to 3000, i.e., it is a very fine abrasive sandpaper.

Flexible block 72 is preferably cut to a predetermined dimension less than two inches square, and preferably is the same size as the strip of sandpaper in use. Block 72 is made of soft, flexible rubber.

Polishing compound 74 is a liquid and has an abrasive quality sufficient to remove sand scratches of the type made by 2000 grit sandpaper, i.e., it is a very fine abrasive polish compound. It need not be dispensed from a bottle as depicted in FIG. 9; it may be dispensed from a flexible, resealable packet, not shown.

Figure 10:
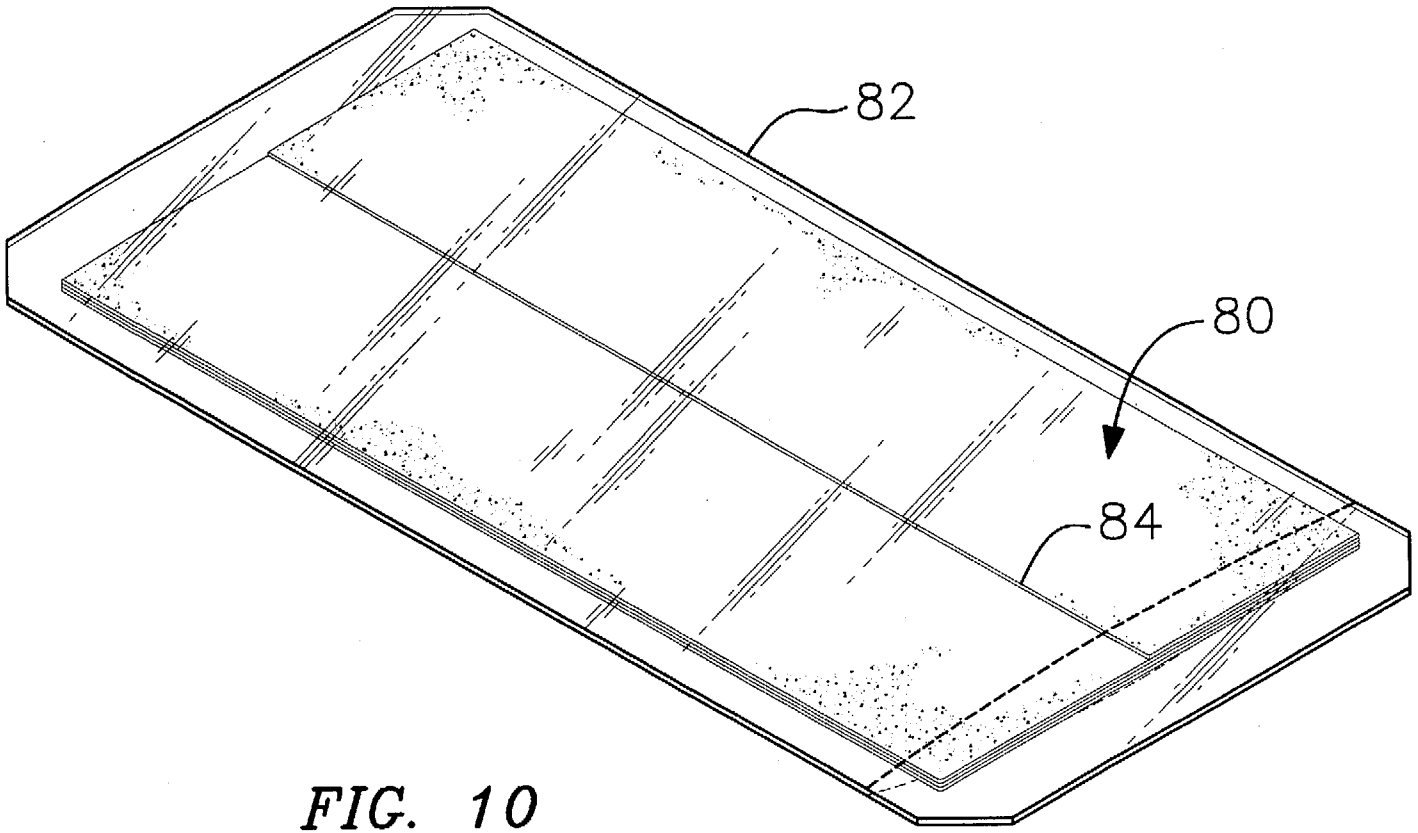
FIG. 10 is a perspective view of a polishing cloth and a polishing cloth dispenser.

FIG. 10 depicts a polishing cloth 80 that is dispensed from a dispenser 82. A plurality of such cloths 80 are contained within dispenser 82, said dispenser having a flexible and resilient flap 84 that covers the undispensed cloths. Cloth 80 is impregnated with an abrasive of the same fineness as polishing compound 74 and thus said cloth may be used in lieu of said compound 74.

The novel paint chip repair method of the present invention begins with surface preparation. Surface rust, dirt, road film, wax, etc., are brushed out with the glass fiber bristles 12 of the novel brush 10, or the bristles or abrasives (FIG. 6) of the other embodiments of said brush. A gentle scuffing of the edges of the chip and undercoats helps promote adhesion of the touch up paint while minimizing damage to the surrounding paint by abrasion.

An applicator 62 is then removed from the novel package 60 and its tip 68 is trimmed as required, i.e., to a point if needed for very small chips or scratches. The tip of the applicator is dipped in touch-up paint 69 (FIG. 8) and the wetted tip of said applicator is then wiped around the chipped area. If the proper color of touch up paint is not immediately available, a clear paint is used. The edges of the chipped area are wetted and recesses are similarly coated. This helps prevent trapped air bubbles and seals off the substrate and undercoats for corrosion protection.

A second application of paint is then used to build the touch up paint higher than the surrounding paint.

The chip is functionally fixed at this point to prevent perforation of metal body panels and blistering of the surrounding area.

If an even better cosmetic repair is desired, the build up area of touch up paint is sanded using small flexible sanding block 72 and the microfine sandpapers 70. The sanding is not started until at least a few days after application of the touch-up paint. Since conventional touch-up paints are lacquer based and have a low solids/high solvent proportion, the paint shrinks as the solvents evaporate. If the touched up area shrinks lower than the surrounding paint, it may be necessary to scuff the area with the glass fibers 12 to promote adhesion and apply more touch-up paint later.

During sanding, block 72 is typically squeezed to bow the lower surface and permit contact primarily on the raised portion of the touchup paint. The area should be constantly flushed with water during sanding. One section of sandpaper 70 is usually sufficient for a single chip and it is easier to polish the sand scratches if the final sanding is done with a somewhat worn piece of paper.

The sanded area is inspected about every six strokes to make sure a minimum of paint is removed from the surrounding area. The built-up touch-up paint holds the paper off the surrounding paint but as it is sanded lower, the paper begins to lightly contact the surrounding paint. As this continues, a glossy-appearing ring around the touch-up paint shrinks in width and disappears when the touch-up paint is sanded flush with the surrounding paint.

After sanding, the area is rubbed with microfine polish 74 applied with a soft cloth, or a pre-impregnated cloth 80 is taken from dispenser 82 and used in the same way. The result is a smooth, flat, unbroken surface which has no edges, bumps or pits to reflect light. The inventive kit can be used by the average consumer and can be manufactured and distributed for a retail price in the five to fifteen dollar range.

Sanding block 72, polishing papers 70, ultrafine polish 74, and impregnated cloth 80 are also extremely effective at removing scratches, black rub marks, and scuff marks from other painted surfaces.

The novel polishing means are not limited to use in the automotive context. It also has utility in cleaning plastic automotive lenses or motorcycle or industrial face shields, and the like.

This invention is clearly new and useful. Moreover, it was not obvious to those of ordinary skill in this art at the time it was made.

It will thus be seen that the objects set forth above, and those made apparent from the foregoing description, are efficiently attained. Since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been disclosed,

What is claimed is:

1. A paint blemish repair kit, comprising:

a touch-up paint compatible with all colors;

a fine abrasive surface preparation tool;

a paint applicator;

wherein said fine abrasive surface preparation tool is a fiberglass bristled brush;

wherein said fiberglass bristled brush includes an inner barrel and an outer barrel that are rotatable with respect to one another and whereby relative rotation between said inner and outer barrels in a first direction causes fiberglass bristles to extend from said brush and relative rotation between said inner and outer barrels in a second direction opposite to the first direction causes retraction of said bristles into said brush;

wherein said fiberglass bristeled brush further comprises external screwthreads formed on an outer surface of said inner barrel and a radially inwardly extending pawl formed on an inner surface of said outer barrel in meshing engagement with said external screwthreads, and a "U"-shaped slot formed in said outer barrel in surrounding relation to said pawl, said outer barrel being formed of a flexible and resilient material to facilitate ejection from an injection mold of nonrotational type.

2. A paint blemish repair kit, comprising:

a touch-up paint compatible with all colors;

a fine abrasive surface preparation tool;

a paint applicator;

wherein said fine abrasive surface preparation tool is a fiberglass bristled brush;

wherein said fiberglass bristled brush includes an inner barrel and an outer barrel that are rotatable with respect to one another and whereby relative rotation between said inner and outer barrels in a first direction causes fiberglass bristles to extend from said brush and relative rotation between said inner and outer barrels in a second direction opposite to the first direction causes retraction of said bristles into said brush;

wherein said fiberglass bristled brush includes a storage cavity formed in said brush for storing replacement brush cartridges.

3. A paint blemish repair kit, comprising:

a touch-up paint compatible with all colors;

a fine abrasive surface preparation tool;

a paint applicator;

a very fine a very fine abrasive compound;

a very fine abrasive sandpaper; and a small sanding block;

said fine abrasive surface preparation tool being a fiberglass bristled brush including an inner barrel and an outer barrel that are rotatable with respect to one another and whereby relative rotation between said inner and outer barrels in a first direction causes fiberglass bristles to extend from said brush and relative rotation between said inner and outer barrels in a second direction opposite to the first direction causes retraction of said bristles into said brush;

the outer surface of said inner barrel having external screwthreads and the outer barrel having a radially inwardly extending pawl formed on an inner surface in meshing engagement with said external screwthreads, and a "U"-shaped slot formed in said outer barrel in surrounding relation to said pawl, said outer barrel being formed of a flexible and resilient material to facilitate ejection from an injection mold of nonrotational type;

said fiberglass bristled brush having a easily accessible cavity for storage of replacement cartridges and having a sufficient space on an exterior surface thereof to accommodate a warning label;

said touch-up paint being clearcoat or transparent;

said applicator having the same size and shape as paper matches;

said polishing compound having an abrasive quality sufficient to substantially remove sand scratches from ultrafine sandpaper and fiberglass bristles;

said sandpaper being precut to dimensions that match those of the sanding block;

said sandpaper having a grit between 1500 to 3000;

said sandpaper being wet or dry sandpaper; and said small sanding block being formed of a flexible rubber.

4. A reusable fiberglass bristled brush for surface preparation including removing contaminants in a chip in a painted surface, comprising:

an inner barrel and an outer barrel that are rotatable with respect to one another and whereby relative rotation between said inner and outer barrels in a first direction causes fiberglass bristles to extend from said brush and relative rotation between said inner and outer barrels in a second direction opposite to the first direction causes retraction of said bristles into said brush;

external screwthreads formed on an outer surface of said inner barrel and a radially inwardly extending pawl formed on an inner surface of said outer barrel in meshing engagement with said external screwthreads, and a "U"-shaped slot formed in said outer barrel in surrounding relation to said pawl, said outer barrel being formed of a flexible and resilient material facilitating ejection from an injection mold of nonrotational type;

a storage cavity formed in said brush for storing replacement brush cartridges; and a cylindrical surface on said outer barrel of said brush that includes sufficient space for a warning label.

5. A disposable fiberglass bristled brush for surface preparation or removing contaminants in a chip in a painted surface, comprising:

an elongate base for use as a holder;

a plurality of fiberglass bristles of predetermined length extending from a leading end of said holder;

a closure means for selectively covering said fiberglass bristles prior to use of said brush, said closure means being releasably attachable to a trailing end of said elongate base;

a second bundle of fiberglass bristles fixedly secured to a second end of said elongate base;

a second closure means for selectively covering said second bundle prior to use of said brush, said second closure means being releasably attachable to a second end of said elongate base.

6. A disposable fiberglass bristled brush for surface preparation of removing contaminants in a chip in a painted surface, comprising:

an elongate base for use as a holder;

a plurality of fiberglass bristles of predetermined length extending from a leading end of said holder;

a closure means for selectively covering said fibergass bristles prior to use of said brush, said closure means being releasably attachable to a trailing end of said elongate base;

an elongate pusher having a convex trailing end;

said elongate base formed of a resilient and flexible material for slidingly receiving said elongate pusher and said fiberglass bristles;

whereby squeezing a trailing end of said elongate housing displaces said elongate pusher and hence said fiberglass bristles to thereby expose more of said fiberglass bristles as said fiberglass bristles are used up.

* * * * *

UNITED STATES PATENT AND TRADEMARK OFFICE

CERTIFICATE OF CORRECTION

PATENT NO. : 5,730,644

DATED : March 24, 1998

INVENTOR(S) : John Pfanstiehl

It is certified that error appears in the above-identified patent and that said Letters Patent is hereby corrected as shown below:

Column 11, line 61, delete "a very fine" and after "abrasive" insert --polish--.
Column 13, line 11, delete "fibergass" and insert --fiberglass--.

Signed and Sealed this

Sixth Day of October, 1998

*Attest:*

BRUCE LEHMAN

*Attesting Officer*

*Commissioner of Patents and Trademarks*